US008109289B2

(12) United States Patent
Trnka et al.

(10) Patent No.: US 8,109,289 B2
(45) Date of Patent: Feb. 7, 2012

(54) SYSTEM AND METHOD FOR DECENTRALIZED BALANCING OF HYDRONIC NETWORKS

(75) Inventors: Pavel Trnka, Prague (CZ); Vladimir Havlena, Prague (CZ); Jaroslav Pekar, Pacov (CZ); Axel Hilborne-Clarke, Arnsberg (DE)

(73) Assignee: Honeywell International Inc., Morristown, NJ (US)

( * ) Notice: Subject to any disclaimer, the term of this patent is extended or adjusted under 35 U.S.C. 154(b) by 589 days.

(21) Appl. No.: 12/336,319

(22) Filed: Dec. 16, 2008

(65) Prior Publication Data

US 2010/0147394 A1 Jun. 17, 2010

(51) Int. Cl.
*F16K 31/02* (2006.01)

(52) U.S. Cl. ..... 137/487; 137/487.5; 137/563; 700/282

(58) Field of Classification Search ..... 137/487, 137/487.5, 87.04, 563; 700/282
See application file for complete search history.

(56) References Cited

U.S. PATENT DOCUMENTS

| | | | | |
|---|---|---|---|---|
| 5,190,068 | A * | 3/1993 | Philbin | 137/8 |
| 5,209,401 | A | 5/1993 | Fiedrich | |
| 5,331,995 | A * | 7/1994 | Westfall et al. | 137/8 |
| 5,370,257 | A | 12/1994 | Chameroy et al. | |
| 5,388,607 | A * | 2/1995 | Ramaker et al. | 137/88 |
| 5,472,014 | A * | 12/1995 | Carlson | 137/556 |
| 6,347,748 | B1 | 2/2002 | Lyons | |

(Continued)

FOREIGN PATENT DOCUMENTS

| | | | |
|---|---|---|---|
| EP | 0128808 | A1 | 12/1984 |
| EP | 0 548 389 | A1 | 6/1993 |
| FR | 2903763 | | 1/2008 |
| WO | WO 95/34761 | A1 | 12/1995 |
| WO | WO 00/57111 | A1 | 9/2000 |
| WO | WO 2005/119129 | A1 | 12/2005 |

OTHER PUBLICATIONS

Notification of Transmittal of the International Search Report and the Written Opinion of the International Searching Authority, or the Declaration dated Jul. 19, 2010 in connection with International Patent Application No. PCT/US2009/066696.

Jaroslav Pekar, "Method and System for Model-Based Multivariable Balancing for Distributed Hydronic Networks", U.S. Appl. No. 12/193,955, filed Aug. 19, 2008.

(Continued)

*Primary Examiner* — Craig Schneider
*Assistant Examiner* — William McCalister

(57) ABSTRACT

A method includes associating a plurality of valve balancing units with a plurality of valves in a hydronic network. The method also includes adjusting a setting of at least one of the valves using at least one of the valve balancing units to balance the hydronic network. Adjusting the setting could include identifying a differential pressure across a valve and a flow rate of material through that valve. Adjusting the setting could also include comparing the identified differential pressure to a target differential pressure and/or the identified flow rate to a target flow rate. Adjusting the setting could further include instructing an actuator to adjust the setting until the identified differential pressure is within a first threshold of the target differential pressure and/or the identified flow rate is within a second threshold of the target flow rate.

12 Claims, 5 Drawing Sheets

U.S. PATENT DOCUMENTS

| | | | | |
|---|---|---|---|---|
| 6,394,361 | B1 | 5/2002 | Fridmann et al. | |
| 6,983,764 | B2 | 1/2006 | Arrowood, Jr. et al. | |
| 6,991,028 | B2 | 1/2006 | Comeaux et al. | |
| 7,284,709 | B2 | 10/2007 | Guyer | |
| 7,353,843 | B2 | 4/2008 | Arrowood, Jr. et al. | |
| 2005/0161521 | A1 | 7/2005 | Guyer | |
| 2007/0012367 | A1 * | 1/2007 | Hotz et al. | 137/556.3 |

OTHER PUBLICATIONS

Nicolas Couillaud, et al., "Balancing Operation for the Optimisation of Hydronic Networks", 9 pages, Oct. 2005.
Mauro Small, "Non-Iterative Technique for Balancing an Air Distribution System", Feb. 13, 2002, 118 pages.
"Balancing of Distribution System", Mar. 2000, 35 pages.

* cited by examiner

SYSTEM AND METHOD FOR DECENTRALIZED BALANCING OF HYDRONIC NETWORKS

TECHNICAL FIELD

This disclosure relates generally to hydronic systems and more specifically to a system and method for decentralized balancing of hydronic networks.

BACKGROUND

A hydronic network typically employs water, or water-glycol mixtures, as the heat-transfer medium in heating and cooling systems. Some of the oldest and most common examples of hydronic networks are steam and hot-water radiators. In large-scale commercial buildings, such as high-rise and campus facilities, a hydronic network may include both a chilled water loop and a heated water loop to provide both heating and air conditioning. Chillers and cooling towers are often used separately or together to cool water, while boilers are often used to heat water. In addition, many larger cities have a district heating system that provides, through underground piping, publicly available steam and chilled water.

There are various types of hydronic networks, such as steam, hot water, and chilled water. Hydronic networks are also often classified according to various aspects of their operation. These aspects can include flow generation (forced flow or gravity flow); temperature (low, medium, and high); pressurization (low, medium, and high); piping arrangement; and pumping arrangement. Hydronic networks may further be divided into general piping arrangement categories, such as single or one-pipe; two pipe steam (direct return or reverse return); three pipe; four pipe; and series loop.

Some hydronic networks are balanced when installed. However, hydronic networks can be difficult to balance due to several factors. Example factors can include unequal lengths in supply and return lines and/or a larger distance from a boiler (larger distances may result in more pronounced pressure differences). Operators often have several options in dealing with these types of pressure differences. For example, the operators could minimize distribution piping pressure drops, use a pump with a flat head characteristic (include balancing and flow measuring devices at each terminal or branch circuit), and use control valves with a high head loss at the terminals. Hydronic networks can be balanced in some cases by a proportional method, while in other cases the hydronic networks are simply not balanced.

When balancing a hydronic network, an installer or operator often needs to calculate a desired flow rate and differential pressure for the hydronic network. After that, the installer or operator often needs to adjust each valve in the network multiple times until the pressure differential and flow rate in the network are at the desired levels.

SUMMARY

This disclosure provides a system and method for decentralized balancing of hydronic networks.

In a first embodiment, a method includes associating a plurality of valve balancing units with a plurality of balancing valves in a hydronic network. The method also includes adjusting a setting of at least one of the valves using at least one of the valve balancing units to balance the hydronic network. Further, the method includes disassociating the plurality of valve balancing units from the plurality of valves after adjusting the setting.

In a second embodiment, an apparatus includes an actuator, a sensor and a controller. The actuator is configured to adjust a setting of a valve. The sensor configured to measure a first pressure on a first side of the valve and a second pressure on a second side of the valve. The controller is configured to instruct the actuator to adjust the setting of the valve until an identified differential pressure across the valve is within a first threshold of a target differential pressure and an identified flow rate of material through the valve is within a second threshold of a target flow rate. The identified differential pressure is based on the first and second pressures. The identified flow rate is computed from the differential pressure and valve characteristic or directly measured by the sensor.

In a third embodiment, a system includes a plurality of valves in a hydronic network and at least one valve balancing unit. The valve balancing unit(s) includes an actuator, a sensor and a controller. The actuator is configured to adjust a setting of a valve. The sensor configured to measure a first pressure on a first side of the valve and a second pressure on a second side of the valve. The controller is configured to instruct the actuator to adjust the setting of the valve until an identified differential pressure across the valve is within a first threshold of a target differential pressure and an identified flow rate of material through the valve is within a second threshold of a target flow rate. The identified differential pressure is based on the first and second pressures. The identified flow rate is computed from the differential pressure and valve characteristic or directly measured by the sensor.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 6, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system. Also, it will be understood that elements in the figures are illustrated for simplicity and clarity and have not necessarily been drawn to scale. For example, the dimensions of some elements in the figures may be exaggerated relative to other elements to help improve the understanding of various embodiments described in this patent document.

Figure 1:
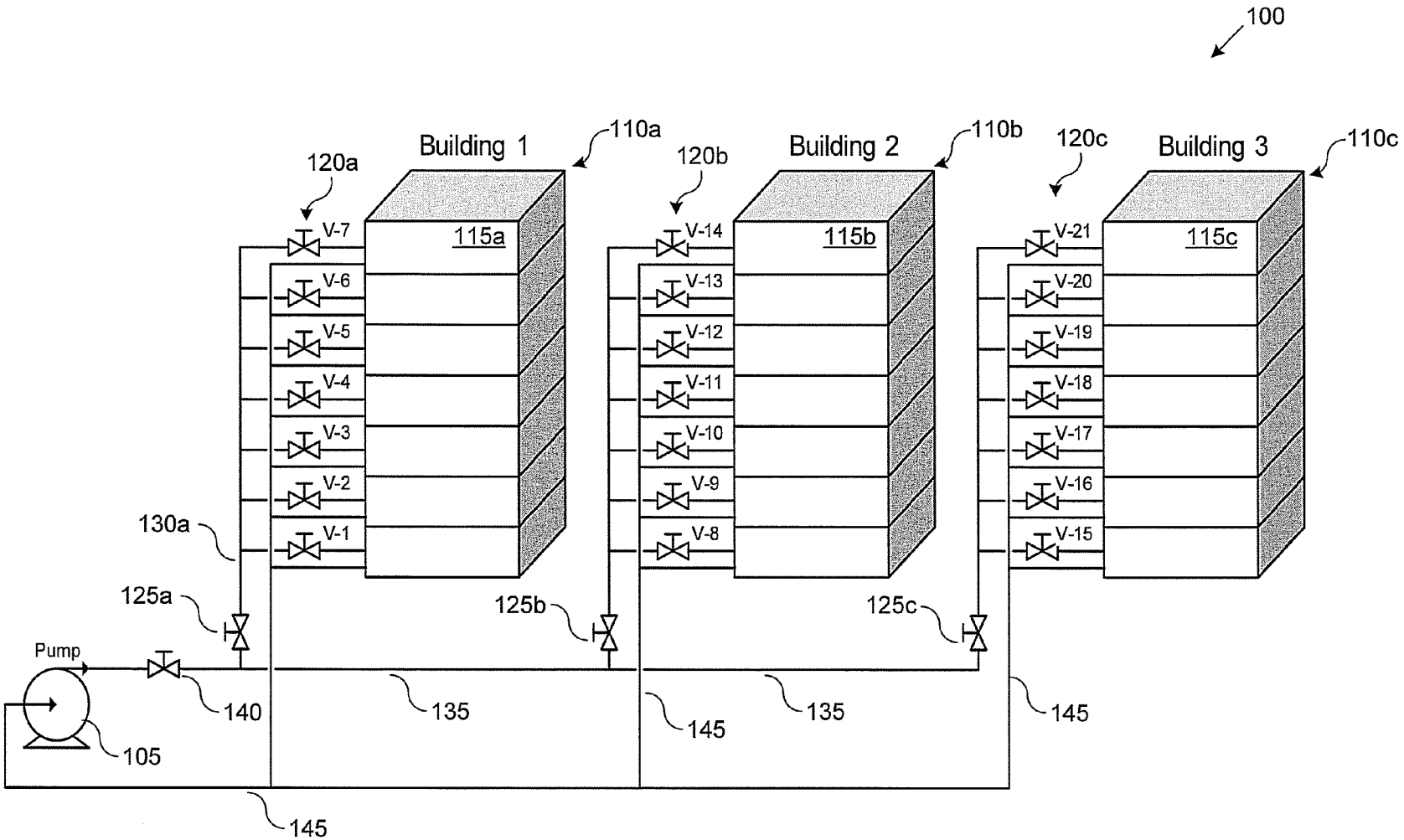
FIG. 1 illustrates an example hydronic network according to this disclosure.

FIG. 1 illustrates an example hydronic network 100 according to this disclosure. The embodiment of the hydronic network 100 shown in FIG. 1 is for illustration only. Other embodiments of the hydronic network 100 could be used without departing from the scope of this disclosure.

A pump 105 provides water or other material (such as for cooling and heating) to a number of buildings 110*a*-110*c*. Each floor 115*a* of the building 110*a* receives the water or other material via one of a plurality of terminal valves 120*a*, where terminal valve denotes last balancing valve before terminal units. Similarly, each floor 115*b* of building 110*b* receives the water or other material via one of a plurality of terminal valves 120*b*. Further, each floor 115*c* of building 110*c* receives the water or other material via one of a plurality of terminal valves 120*c*. Each of the terminal valves 120*a*-120*c* can be any suitably arranged flow control valve configured to operate in a hydronic network.

Each of the terminal valves 120*a*-120*c* receives water or other material from a respective riser valve 125*a*-125*c*. For example, terminal valves 120*a* receive water or other material via riser pipe 130*a* from riser valve 125*a*. Each of the riser valves 125*a*-125*c* is coupled via a main pipe 135 to a main pipe valve 140. Each of the riser valves 125*a*-125*c* and the main pipe valve 140 can be any suitably arranged flow control valve configured to operate in a hydronic network.

In this example, the pump 105 pumps water or other material to each building 110*a*-110*c* via the main pipe valve 140, a respective riser valve 125*a*-125*c*, and a respective set of terminal valves 120*a*-120*c*. The water or other material is returned to the pump 105 via a return pipe 145.

In this example, the main pipe valve 140, the riser valves 125 and terminal valves 120 in hierarchical connection are used as balancing valves to balance the hydronic network. Additional embodiments may include more levels of balancing valves hierarchy.

In conventional hydronic systems, in order to realize the target flow rate in FIG. 1, each valve 120*a*-120*c*, 125*a*-125*c*, 140 would be adjusted. For example, an operator can calculate pressure differentials for each of the terminal valves 120*a*-120*c*, each of the riser valves 125*a*-125*c*, and the main valve 140 corresponding to the target flow rate. The pressure differential is the difference in pressure in the pipe on a first side of a valve and on a second side of the valve. After that, each valve can be adjusted to obtain the target pressure differential and flow rate for that valve. The operator may be required to perform several manual adjustments at each valve (several iterations) in order to obtain the target flow rate and/or target differential pressure limits.

A hydronic network may be balanced by more than one combination of balancing valve positions. To achieve energy optimal balancing such combination should be selected with the largest pressure drop on the main pipe valve. Then the pumping power can be reduced by the power, which is being lost on the main pipe valve with simultaneous opening of the main pipe valve.

Figure 2:
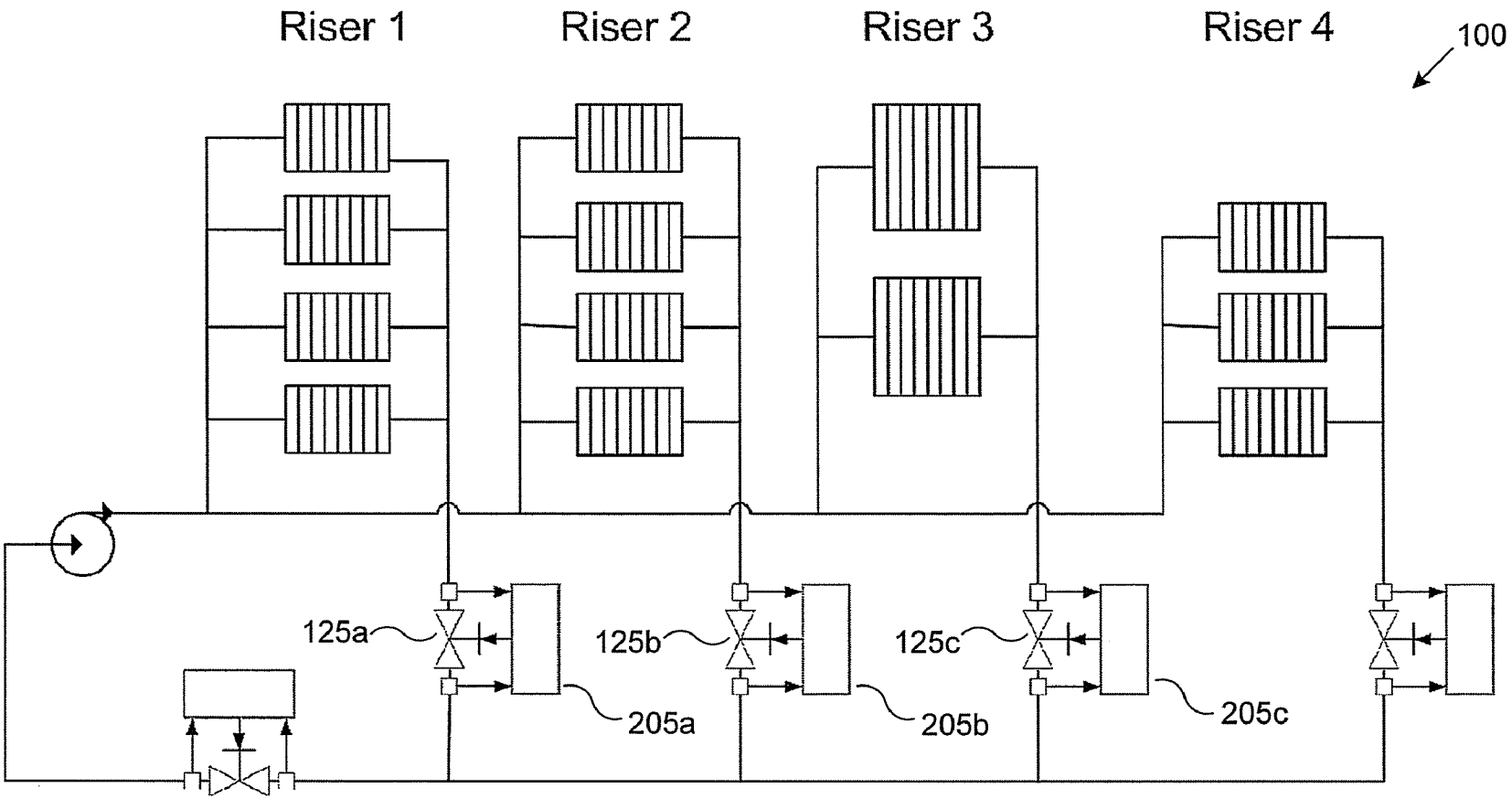
FIG. 2 illustrates additional details of an example hydronic network according to this disclosure.

FIG. 2 illustrates additional details of an example hydronic network 100 according to this disclosure. The details of the hydronic network 100 shown in FIG. 2 are for illustration only. Other embodiments of the hydronic network 100 could be used without departing from the scope of this disclosure.

In this example, the hydronic network 100 includes one or more valve balancing units 205*a*-205*c*. Each valve balancing unit 205*a*-205*c* is adapted to couple with one of the valves in the hydronic network 100, in this case the terminal valves 120*a*-120*c* (although similar valve balancing units could be coupled to the riser valves 125*a*-125*c* and the main valve 140).

In accordance with this disclosure, in order to reduce or minimize the amount of energy required for the pump 105 to pump the water or other material through the hydronic network 100, flow rate setpoints for valve balancing units are determined from the target flow rates obtained by network design (either by an operator or automatically, such as by a computer program). The operator can then enter flow determination information into each valve balancing unit in the hydronic network 100. The flow determination information could include a target flow rate and/or a target differential pressure limit for each valve.

In some embodiments, the operator enters the flow determination information into each valve balancing unit using a portable operator device. The operator device may be a computer, personal digital assistant (PDA), cellular telephone, or any other device capable of transmitting, processing, and/or receiving signals via wireless and/or wired communication links. In particular embodiments, the operator device is configured to couple to a computer, and the operator is able to calculate the flow determination information using the computer at a central location and download the information into the operator device. Thereafter, the operator may download the information from the operator device into a valve balancing unit at a remote location (such as at a valve location in the hydronic network 100). The operator device can be adapted to transmit and receive flow determination information via either a wireless communication medium or a wired communication medium.

In order to obtain the target flow rates, the valve balancing units in the hydronic network 100 can adjust each of the terminal valves 120*a*-120*c*, the riser valves 125*a*-125*c*, and the main valve 140. Each valve balancing unit can determine a pressure differential at its respective valve and a difference between a target flow rate and an actual flow rate at that valve. In some embodiments, the valve flow can be determined by any other method used to determine flow rate, such as ultrasonic means. Once the valve balancing unit determines valve flow information (such as the pressure differential at its valve and the difference between a target flow rate and an actual flow rate at the valve), the valve balancing unit adjusts the valve to a valve position corresponding to a target flow rate and/or target differential pressure limit (e.g., adjusts the valve to achieve the target flow rate and/or target differential pressure limit). In some embodiments, each valve balancing unit is instructed by the operator to adjust its respective valve. In other embodiments, the valve balancing unit is configured to adjust its respective valve automatically in response to determining the valve flow information.

As an example, the valve balancing unit 205*b* attached to riser valve 125*b* can determine the valve flow information for the riser valve 125*b*. Once the valve balancing unit 205*b* determines the valve flow information for the riser valve 125*b*, the valve balancing unit 205*b* adjusts riser valve 125*b* to a valve setting (valve position) corresponding to the target flow rate and/or target differential pressure limit for the riser valve 125*b*.

The valve balancing unit coupled to any other valve within the hydronic network 100 could operate in a similar manner. Each valve balancing unit therefore determines the valve flow information for its own valve and adjusts the valve setting for its own valve based on that valve flow information. A subset of values or all valves in the hydronic network 100 could have an associated valve balancing unit attached thereto. After that, the operator is able to re-balance the hydronic network 100 by providing one setting adjustment to each valve balancing unit (as opposed to multiple adjustments for each valve). The setting adjustment could be provided to each valve balancing unit wirelessly (either shorter-range or longer-range) or via a physical connection.

Accordingly, the operator can utilize a plurality of valve balancing units to balance the hydronic network 100. The operator can download individualized flow determination information into each valve balancing unit based on the valve to which that valve balancing unit is or will be attached. Thereafter, the valve balancing unit can adjust its associated valve in accordance with its flow determination information.

It may be noted that a valve balancing unit may or may not remain coupled to a single valve. For example, in some embodiments, the functionality of the valve balancing unit could be incorporated into a valve controller that remains coupled to a valve. In other embodiments, the valve balancing unit could represent a portable unit that can be selectively attached to a valve and used to adjust that value, at which point the valve balancing unit is removed (and can be used with a subsequent valve). Multiple valve balancing units can also be used at the same time to adjust multiple valves in parallel, where each of the valve balancing units operates so that its associated valve achieves a target flow rate and/or a target pressure differential. Note that no communication may be required between multiple valve balancing units.

Figure 3:
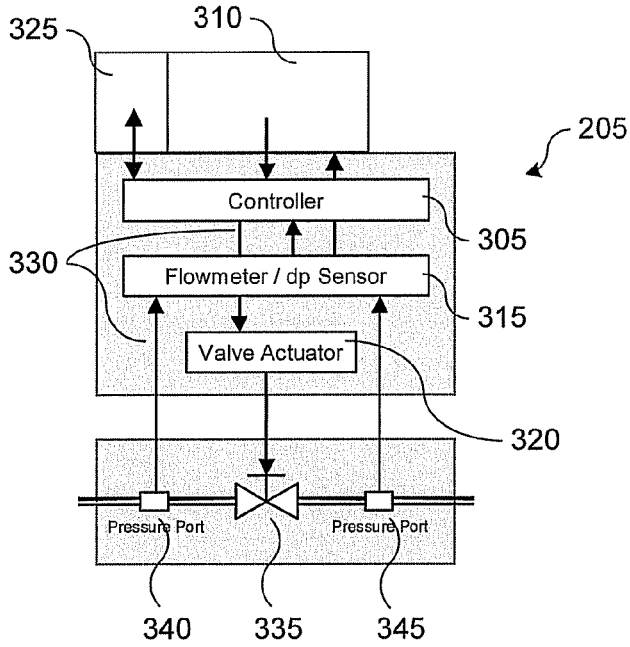
FIGS. 3 and 4 illustrate an example valve balancing unit according to this disclosure.
Figure 4:
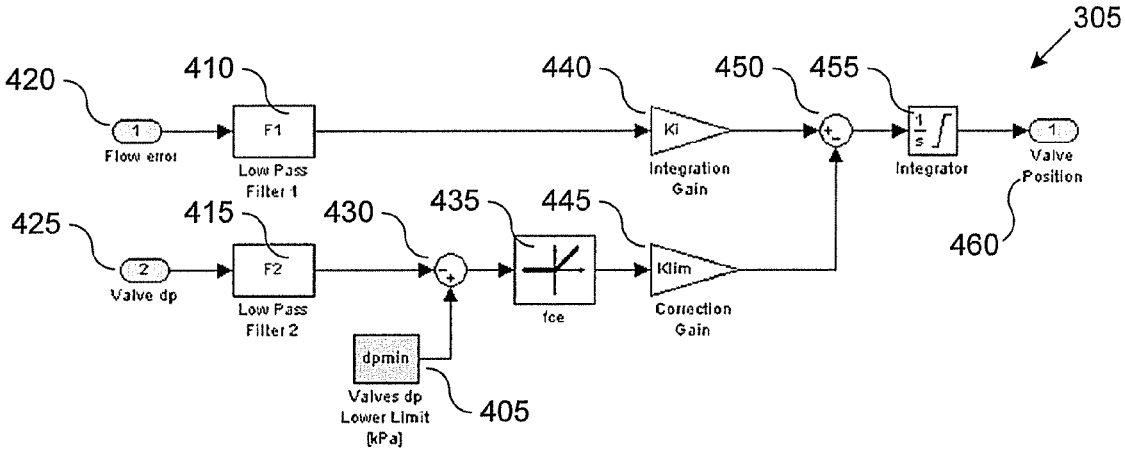

FIGS. 3 and 4 illustrate an example valve balancing unit 205 according to this disclosure. In particular, FIG. 3 illustrates an example valve balancing unit 205 according to this disclosure. The embodiment of the valve balancing unit 205 shown in FIG. 3 is for illustration only. Other embodiments of the valve balancing unit 205 could be used without departing from the scope of this disclosure.

In this example, the valve balancing unit 205 includes a controller 305, a memory 310, a sensor 315, a valve actuator 320, and an input/output (I/O) interface 325. The components 305-325 are interconnected by one or more communication links 330 (such as a bus). The valve balancing unit 205 is adapted to be attached to a valve 335 (such as a terminal valve 120*a*-120*c*, riser valve 125*a*-125*c*, or main valve 140). In some embodiments, the valve balancing unit 205 can be selectively coupled to the valve 335 so that the valve balancing unit 205 can be removed from the valve 335 after a balancing operation is performed. It is understood that the valve balancing unit 205 may be differently configured and that each of the listed components may actually represent several different components.

The controller 305 is configured to control the operation of the sensor 315 and the valve actuator 320, such as based on instructions stored in the memory 310. For example, the controller 305 could retrieve information, such as a setpoint (discussed below) and store information, such as valve flow information, in the memory 310. In some embodiments, the controller 305 may represent one or more processors, microprocessors, microcontrollers, digital signal processors, or other processing devices (possibly in a distributed system).

The memory 310 can represent any suitable storage and retrieval device(s), such as volatile and/or non-volatile memory. The memory 310 could store any suitable information, such as instructions used by the controller 305 and flow determination information (like target and actual pressure differentials, target and actual flow rates, and a setpoint).

The sensor 315 is configured to calculate an actual pressure differential and an actual flow through the valve 335. The sensor 315 can then send the actual pressure differential and the actual flow rate to the controller 305 or the memory 310. In this example, the sensor 315 is coupled to a first pressure port 340 and a second pressure port 345. The first pressure port 340 is adapted to sense a pressure on a first side of the valve 335, and the second pressure port 345 is adapted to sense a pressure on a second side of the valve 335. Each of the pressure ports 340 and 345 are configured to send the respective sensed pressure to the sensor 315. In some embodiments, the sensor 315 is configured to calculate a pressure differential and flow rate based on the received sensed pressures from the pressure ports 340 and 345. In other embodiments, the sensor 315 sends the sensed pressures to the controller 305 and/or the memory 310, and the controller 305 is configured to calculate the pressure differential and flow rate based on the received sensed pressures from the pressure ports 340 and 345. In yet other embodiments, a combination of these approaches could be used. The sensor 315 includes any suitable sensing structure, such as a flowmeter and differential pressure (DP) sensor.

The valve actuator 320 is adapted to couple to the valve 325. The valve actuator 320 is configured to operate the valve 335 to obtain a desired valve setting (such as by adjusting the valve to obtain a desired flow rate). The valve actuator 320 is responsive to commands received from the controller 305 to operate the valve 335. The valve actuator 320 includes any suitable structure for adjusting the valve 335.

The I/O interface 325 facilitates communication with external devices or systems. For example, the I/O interface 325 may be configured to couple to an operator device via a wireless or wired communication link, which allows the I/O interface 325 to receive flow determination information or other information from the operator device. The I/O interface 325 sends the flow determination information or other information to the controller 305 or the memory 310. In some embodiments, the I/O interface 325 may include a wireless or wired transceiver, display, or keyboard/keypad.

FIG. 4 illustrates an example controller 305 in the valve balancing unit 205 according to this disclosure. The embodiment of the controller 305 shown in FIG. 4 is for illustration only. Other embodiments of the controller 305 could be used without departing from the scope of this disclosure.

In this example, the controller 305 operates to estimate the flow from measurements of valve pressure drop and the valve's characteristics. As shown here, the controller 305 includes a pressure drop limiter 405, a first low-pass filter 410, and a second low-pass filter 415. The low-pass filter 410 receives a flow error 420, which represents the difference between a target flow rate and an actual flow rate. The low-pass filter 415 receives a valve differential pressure 425. The low-pass filter 410 and low-pass filter 415 filter the signals to help suppress the influences of measurement error and high-frequency disturbances.

The controller 305 limits the differential pressure on the valve 335 using the differential pressure drop limiter 405, which defines the minimum pressure drop allowable for the valve. The controller 305 passes the differential pressure signal from the low-pass filter 415 and the minimum pressure drop signal from the pressure drop limiter 405 to a combiner 430. Thereafter, the controller 305 applies a non-linear function 435 to the combined differential pressure signal. An integration gain 440 is applied to the flow error signal, and a correction gain 445 is applied to the resultant pressure differential signal from the non-linear function 435. The signals are combined by a combiner 450 and integrated by an integrator 455 to obtain a target valve position 460. The controller 305 may be configured to repeat this process at a specified time interval (for example, between ten seconds to one minute).

Figure 5:
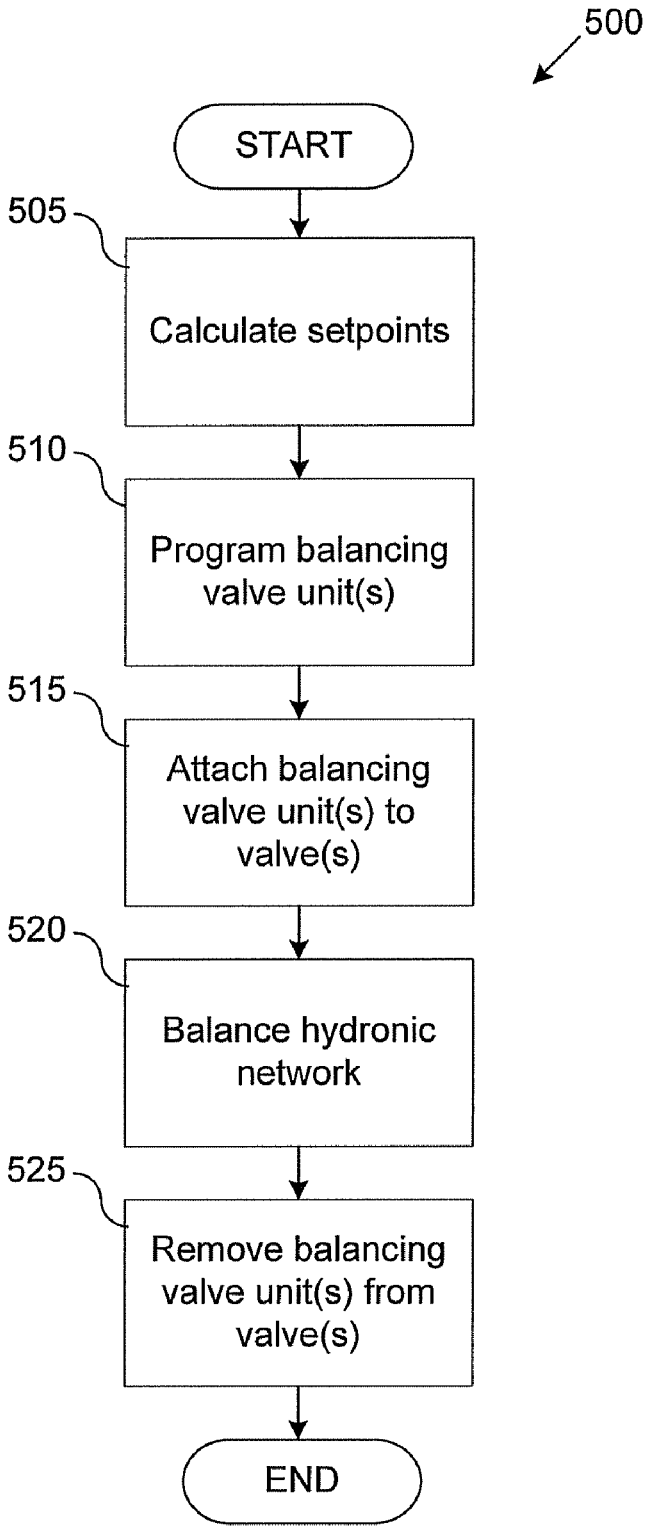
FIG. 5 illustrates an example method for balancing a hydronic network according to this disclosure.

FIG. 5 illustrates an example method 500 for balancing a hydronic network according to this disclosure. The embodiment of the method 500 shown in FIG. 5 is for illustration only. Other embodiments of the method 500 could be used without departing from the scope of this disclosure.

After a determination is made that a hydronic network needs to be balanced (such as after a new installation), setpoints for the hydronic network are calculated at step 505. This could include, for example, an operator calculating target flow rates and target pressure differentials for the hydronic network. The setpoints for each valve can be based on each valve's relationship with other valves in the hydronic network. The setpoints may represent the target flow rate and target pressure differential for each valve necessary to obtain a target flow rate and target pressure differential for the main pipe valve 140.

In particular embodiments, step 505 could occur as follows. First, the operator determines the flow rate setpoints and differential pressure limits from the network design and target flows for each of the terminal valves balancing unit 120*a*-120*c*. Second, the operator calculates the setpoints for each of the riser valve balancing units 125*a*-125*c*, where these calculations are based on the setpoints for the riser valve's associated terminal valves. For example, if each of the terminal valves 120*a* is calculated to have a flow of one hundred liters per hour (100 l/h), the riser valve 125*a* can be calculated to have a flow of seven times one hundred liters per hour minus an offset (for example, 7×100 l/h−5 l/h=695 l/h). Third, the operator calculates the setpoint for the main valve 140 based on the setpoints for the riser valves 125*a*-125*c*.

One or more valve balancing units 205 are programmed with flow determination information at step 510. This could include, for example, programming each valve balancing unit 205 with a setpoint associated with the valve to which the valve balancing unit 205 will be attached. For example, if a particular valve balancing unit 205 is to be attached to riser valve 125*a*, the particular valve balancing unit 205 can be programmed with the setpoints calculated for the riser valve 125*a*. As a particular example, the operator could program each valve balancing unit 205 by downloading the flow determination information from an operator device into each valve balancing unit 205 via the I/O interface 325 or by otherwise entering the flow determination information via an I/O interface 325 (such as via a keyboard/keypad).

Each valve balancing unit 205 is attached to a valve corresponding to the setpoint programmed into the memory 310 of that valve balancing unit 205 at step 515. Each valve unit 205 could be installed by attaching the valve balancing unit 205 to the valve such that the valve actuator 320 is in a position to operate the valve.

The valve balancing units 205 balance the hydronic network 100 at step 520. This could include operating the valves in the hydronic network 100 until a steady state balance is obtained. The steady state balance could be defined as the time when the actual flow rate equals the target flow rate and/or the actual pressure differential equals the target pressure differential (where "equal" may mean within a specified threshold, which could possibly be zero). Each valve balancing unit 205 can operate its associated valve by adjusting the valve position to be more open (allow more material to flow and reduce pressure differential) or more closed (allow less material to flow and increase pressure differential).

Once the hydronic network is balanced, each valve balancing unit 205 is removed from its valve at step 525. In this example embodiment, the operator has been able to balance the hydronic network 100 by making two trips to each valve: a first trip to install the valve balancing unit 205 and a second trip to remove the balancing valve unit 205.

Figure 6:
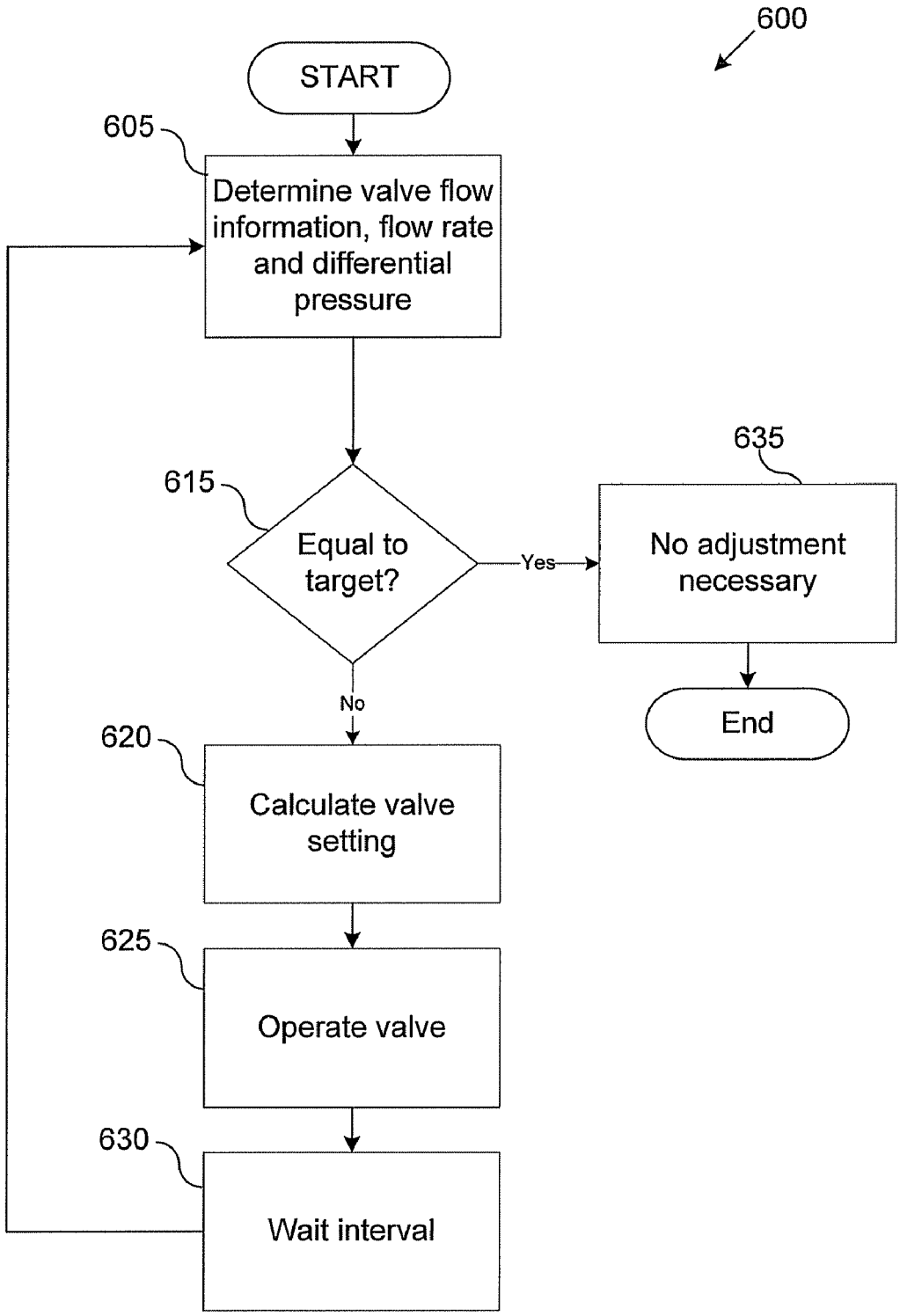
FIG. 6 illustrates an example method for operating a valve in a hydronic network according to this disclosure.

FIG. 6 illustrates an example method 600 for operating a valve in a hydronic network according to this disclosure. The embodiment of the method 600 shown in FIG. 6 is for illustration only. Other embodiments of the method 600 could be used without departing from the scope of this disclosure.

After a valve balancing unit 205 is attached to a valve, the valve balancing unit 205 determines valve flow information at step 605. The valve flow information could include the flow rate of material through the valve and the pressure on each side of the valve. The valve balancing unit 205 could receive the flow rate information and the pressure information via the sensor 315, first pressure port 340, and second pressure port 345. The valve balancing unit 205 calculates the differential pressure value. The flow can be measured directly or computed from differential pressure and valve characteristics. In some embodiments, the valve balancing unit 205 can measure differential pressure across the valve and uses this value with a valve characteristic to compute the flow.

As noted above, the valve balancing unit 205 may previously have been programmed with flow determination information, such as target values. When programmed with the flow determination information, the valve balancing unit 205 stores a setpoint (such as a target flow rate and a target pressure differential). At step 615, the valve balancing unit 205 calculates a difference between the target flow rate and the actual flow rate and a difference between the target pressure differential and the actual differential and determines if an adjustment of the valve is necessary.

If the valve flow information is substantially different than the flow determination information (such as when a difference exceeds a threshold), the valve balancing unit 205 calculates a new valve position at step 620. For example, the actual flow rate could be inside or outside a window defined around the target flow rate (plus or minus a first margin value, which could be operator-specified). Also, the actual pressure differential could be inside or outside a window defined around a target pressure differential (plus or minus a second margin, which could be operator-specified). If either or both is true, the valve balancing unit 205 could determine that the valve needs to be adjusted. In step 620, the valve balancing unit 205 may calculate a valve position necessary to obtain the target flow rate or pressure differential.

The controller 305 instructs the valve actuator 320 to operate the valve at step 625. The valve actuator 320 operates the valve such that the valve is set to a position that is more open or more closed, depending upon the instructions received from the controller 305. The valve balancing unit 205 then waits for a specified interval at step 630 (for example ten seconds to one minute). The valve balancing unit 205 may allow the interval to elapse in order, for example, to allow the settings of the valve and the settings of other valves in the hydronic network to take effect. Thereafter, the valve balancing unit 205 returns to step 605.

If adjustment of the valve is not necessary at step 615, the process ends at step 635. For example, if the actual flow rate is within a specified window and the actual pressure differential is within a specified window, the valve balancing unit 205 can determine that the valve is at a setting corresponding to its setpoints and that no more adjustments are necessary.

While FIGS. 1 through 6 have illustrated various features of example embodiments for the present invention, various changes may be made to the figures. For example, a hydronic network could include any suitable number and type(s) of values, along with any suitable number of valve balancing units 205. Also, various components within the valve balancing unit 205 could be combined, omitted, or further subdivided and additional components could be added according to particular needs. Further, while FIGS. 5 and 6 each illustrates a series of steps, various steps in each figure could overlap, occur in parallel, occur multiple times, or occur in a different order. In addition, any suitable graphical user interface or other input/output mechanism could be used to interact with an operator or other personnel.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

an actuator configured to adjust a setting of a valve;

a sensor configured to measure a first pressure on a first side of the valve and a second pressure on a second side of the valve; and a controller configured to instruct the actuator to adjust the setting of the valve until an identified differential pressure across the valve is within a first threshold of a target differential pressure and an identified flow rate of material through the valve is within a second threshold of a target flow rate, wherein the identified differential pressure is based on the first and second pressures.

2. The apparatus of claim 1, wherein the controller is configured to identify the differential pressure across the valve.

3. The apparatus of claim 1, wherein the sensor is configured to:

identify the differential pressure across the valve; and provide at least one of the identified differential pressure and the identified flow rate to the controller.

4. The apparatus of claim 1, wherein the controller comprises:

a first filter configured to receive and filter a signal representing the differential pressure across the valve;

a pressure drop limiter configured to output a signal representing a minimum pressure drop across the valve; and a first combiner configured to combine the filtered signal representing the differential pressure across the valve and the signal representing the minimum pressure drop.

5. The apparatus of claim 4, wherein the controller further comprises:

a non-linear function block configured to non-linearly adjust an output of the first combiner; and a first gain unit configured to apply a correction gain to an output of the non-linear function block.

6. The apparatus of claim 5, wherein the controller further comprises:

a second filter configured to receive and filter a signal representing a difference between the target flow rate and the identified flow rate; and a second gain unit configured to apply an integration gain to an output of the second filter.

7. The apparatus of claim 6, wherein the controller further comprises:

a second combiner configured to combine an output of the first gain unit and an output of the second gain unit; and an integrator configured to integrate an output of the second combiner, wherein the setting of the valve is based on an output of the integrator.

8. The apparatus of claim 1, further comprising:

an interface configured to receive the target differential pressure and the target flow rate.

9. The apparatus of claim 8, wherein the interface comprises at least one of a transceiver configured to communicate with an operator device, a keyboard and a keypad.

10. A system comprising:

a plurality of valves in a hydronic network; and at least one valve balancing unit comprising:

an actuator configured to adjust a setting of a specified one of the valves;

a sensor configured to measure a first pressure on a first side of the specified valve and a second pressure on a second side of the specified valve; and a controller configured to instruct the actuator to adjust the setting of the specified valve until an identified differential pressure across the specified valve is within a first threshold of a target differential pressure and an identified flow rate of material through the specified valve is within a second threshold of a target flow rate, wherein the identified differential pressure is based on the first and second pressures.

11. The system of claim 10, wherein the controller comprises:

a first filter configured to receive and filter a signal representing the differential pressure across the valve;

a pressure drop limiter configured to output a signal representing a minimum pressure drop across the valve;

a first combiner configured to combine the filtered signal representing the differential pressure across the valve and the signal representing the minimum pressure drop;

a non-linear function block configured to non-linearly adjust an output of the first combiner;

a first gain unit configured to apply a correction gain to an output of the non-linear function block;

a second filter configured to receive and filter a signal representing a difference between the target flow rate and the identified flow rate;

a second gain unit configured to apply an integration gain to an output of the second filter;

a second combiner configured to combine an output of the first gain unit and an output of the second gain unit; and an integrator configured to integrate an output of the second combiner, wherein the setting of the valve is based on an output of the integrator.

12. The system of claim 10, wherein the controller comprises:

an interface configured to receive the target differential pressure and the target flow rate.

* * * * *